US008485696B2

(12) United States Patent
Pringle et al.

(10) Patent No.: US 8,485,696 B2
(45) Date of Patent: Jul. 16, 2013

(54) LIGHTING AND VENTILATING SYSTEM AND METHOD

(75) Inventors: David L. Pringle, Waukesha, WI (US); Mirko Zakula, New Berlin, WI (US); Jeff Emmerich, Madison, WI (US); Chris Sherwin, Stoughton, WI (US); Kevin Kopp, Pardeeville, WI (US)

(73) Assignee: Broan NuTone, LLC, Hartford, WI (US)

( * ) Notice: Subject to any disclaimer, the term of this patent is extended or adjusted under 35 U.S.C. 154(b) by 333 days.

(21) Appl. No.: 12/902,065

(22) Filed: Oct. 11, 2010

(65) Prior Publication Data

US 2012/0087138 A1 Apr. 12, 2012

(51) Int. Cl.

| | |
|---|---|
| ***F21V 29/02*** | (2006.01) |
| ***F21V 15/01*** | (2006.01) |
| ***F21S 10/02*** | (2006.01) |

(52) U.S. Cl.

USPC ..... 362/373; 362/228; 362/231; 362/234; 362/376

(58) Field of Classification Search

USPC ..... 362/228, 294, 373, 96, 216, 231, 362/234, 376–378

See application file for complete search history.

(56) References Cited

U.S. PATENT DOCUMENTS

| | | | |
|---|---|---|---|
| 6,016,038 | A | 1/2000 | Mueller et al. |
| 6,150,774 | A | 11/2000 | Mueller et al. |
| 6,211,626 | B1 | 4/2001 | Lys et al. |
| 6,292,901 | B1 | 9/2001 | Lys et al. |
| 6,340,868 | B1 | 1/2002 | Lys et al. |
| 6,406,673 | B1 | 6/2002 | Soller et al. |
| 6,484,438 | B2 | 11/2002 | Matsunaga et al. |
| 6,783,081 | B2 | 8/2004 | Pedrotti et al. |
| 6,788,011 | B2 | 9/2004 | Mueller et al. |
| 6,888,322 | B2 | 5/2005 | Dowling et al. |
| 6,948,829 | B2 * | 9/2005 | Verdes et al. ..... 362/227 |
| 6,965,205 | B2 | 11/2005 | Piepgras et al. |
| 6,967,448 | B2 | 11/2005 | Morgan et al. |
| D518,218 | S | 3/2006 | Roberge et al. |
| 7,014,336 | B1 | 3/2006 | Ducharme et al. |
| 7,064,498 | B2 | 6/2006 | Dowling et al. |
| 7,113,541 | B1 | 9/2006 | Lys et al. |
| 7,132,785 | B2 | 11/2006 | Ducharme |
| 7,161,311 | B2 | 1/2007 | Mueller et al. |
| 7,180,252 | B2 | 2/2007 | Lys et al. |
| 7,186,003 | B2 | 3/2007 | Dowling et al. |

(Continued)

FOREIGN PATENT DOCUMENTS

| | | |
|---|---|---|
| AU | 757000 | 1/2003 |
| AU | 2003203584 B2 | 3/2006 |

(Continued)

*Primary Examiner* — Alan Cariaso
(74) *Attorney, Agent, or Firm* — Greenberg Traurig LLP

(57) ABSTRACT

Embodiments of the invention provide a lighting and ventilating system including a main housing. The main housing can include an inlet through which air can be received within the main housing and an outlet through which the air can exit the main housing. A fan wheel can be supported in the main housing and it can be operable to generate a flow of air. A grille can be coupled to the main housing and the grille can include louvers. The system further can include a lamp housing coupled to the grille, the lamp housing can include a first set of illumination devices and a second set of illumination devices. The second set of illumination devices can be capable of emitting a dynamic illumination event.

17 Claims, 7 Drawing Sheets

U.S. PATENT DOCUMENTS

| | | | | |
|---|---|---|---|---|
| 7,246,919 | B2 | 7/2007 | Porchia et al. | |
| D548,868 | S | 8/2007 | Roberge et al. | |
| 7,256,554 | B2 | 8/2007 | Lys | |
| 7,318,659 | B2 | 1/2008 | Demarest et al. | |
| D562,494 | S | 2/2008 | Piepgras | |
| 7,341,698 | B2 | 3/2008 | Pedrotti et al. | |
| D566,323 | S | 4/2008 | Piepgras et al. | |
| 7,352,138 | B2 | 4/2008 | Lys et al. | |
| 7,352,339 | B2 | 4/2008 | Morgan et al. | |
| 7,419,281 | B2 | 9/2008 | Porchia et al. | |
| 7,427,840 | B2 | 9/2008 | Morgan et al. | |
| 7,459,864 | B2 | 12/2008 | Lys | |
| 7,462,997 | B2 | 12/2008 | Mueller et al. | |
| 7,484,860 | B2 | 2/2009 | Demarest et al. | |
| 7,503,675 | B2 | 3/2009 | Demarest et al. | |
| 7,524,089 | B2 * | 4/2009 | Park | 362/294 |
| 7,557,521 | B2 | 7/2009 | Lys | |
| 7,646,029 | B2 | 1/2010 | Mueller et al. | |
| 7,659,673 | B2 | 2/2010 | Lys | |
| 7,835,631 | B2 | 11/2010 | Wang et al. | |
| 8,246,202 | B2 * | 8/2012 | Mart et al. | 362/249.02 |
| 2003/0036030 | A1 | 2/2003 | Doppelt | |
| 2007/0109763 | A1 | 5/2007 | Wolf et al. | |
| 2007/0175085 | A1 | 8/2007 | Chen | |
| 2008/0066372 | A1 | 3/2008 | Fleming | |
| 2008/0232091 | A1 | 9/2008 | Abbondanzio et al. | |
| 2011/0139894 | A1 | 6/2011 | Masterson et al. | |

FOREIGN PATENT DOCUMENTS

| | | |
|---|---|---|
| CA | 2302227 | 7/2004 |
| EP | 1016062 B1 | 8/2002 |
| EP | 1234140 B1 | 8/2005 |

* cited by examiner

LIGHTING AND VENTILATING SYSTEM AND METHOD

BACKGROUND

Conventional lighting and ventilating systems can combine elements of a conventional room ventilating fan with a light fixture. These apparatuses can have a bulky, unaesthetic appearance, can employ a complicated design, can fail to adequately cool the light fixture, and or can employ a design where the components of the apparatus are inefficiently arranged. Additionally, many conventional lighting and ventilating systems can include only one illumination source which can be lacking in some functionality, which can include providing quiescent or dynamic illumination events.

SUMMARY

Some embodiments of the invention provide a lighting and ventilating system including a main housing. The main housing can include an inlet through which air can be received within the main housing and an outlet through which the air can exit the main housing. A fan wheel can be supported in the main housing and it can be operable to generate a flow of air. A grille can be coupled to the main housing and the grille can include louvers. The system further can include a lamp housing coupled to the grille, the lamp housing can include a first set of illumination devices and a second set of illumination devices. The second set of illumination devices can be capable of emitting a dynamic illumination event.

Some embodiments of the invention provide a lighting and ventilating system including a main housing. The main housing can include an inlet through which air can be received within the main housing and an outlet through which the air can exit the main housing. A fan wheel can be supported in the main housing and it can be operable to generate a flow of air. A grille can be coupled to the main housing and the grille can include a lighting aperture. A lamp housing can be coupled to the grille substantially adjacent to the lighting aperture, and the lamp housing can include a first set of illumination devices and a second set of illumination devices. The second set of illumination devices can be capable of emitting a dynamic illumination event. Also, a microprocessor can be included with the system which can be capable of substantially controlling the dynamic illumination event.

Some embodiments of the invention provide a method for lighting a space including providing a main housing and a grille which can be coupled to the main housing. Some embodiments can include a lamp housing which can be coupled to the grille, and the lamp housing can include a first set of illumination devices and a second set of illumination devices. The second set of illumination devices can be capable of emitting a dynamic illumination event. Some embodiments can include activating the second set of illumination devices so that the second set of illumination devices produces the dynamic illumination event.

DETAILED DESCRIPTION

Figure 1:
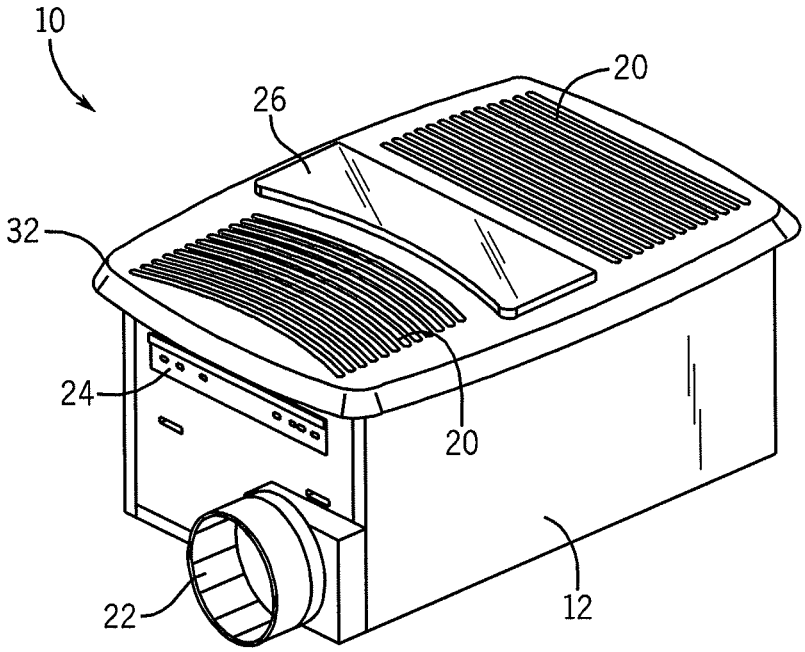
FIG. 1 is a perspective view of a lighting and ventilating system according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

FIG. 1 illustrates a lighting and ventilating system 10 according to one embodiment of the invention. Some embodiments of the system 10 generally can include several components and devices which can perform various functions. In some embodiments of the present invention, the system 10 can include a main housing 12, which can house components of the system 10. The system 10 generally can include a ventilating assembly 14, a lamp housing 16, a first set of illumination devices 18, louvers 20, a ventilation outlet 22, at least one mounting apparatus 24 which can be used to mount the lighting and ventilating system 10 to a surface or a support structure, electrical components, a lens 26, a motor 28, and at least one electrical socket 30.

In some embodiments, the system 10 can be used to illuminate and/or ventilate any room, area, or space. In some embodiments, the system 10 can illuminate the room, area, or space independently of ventilating the room, area, or space. Further, in some embodiments, the system 10 can provide different intensities of illumination to the room, area, or space.

Figure 7:
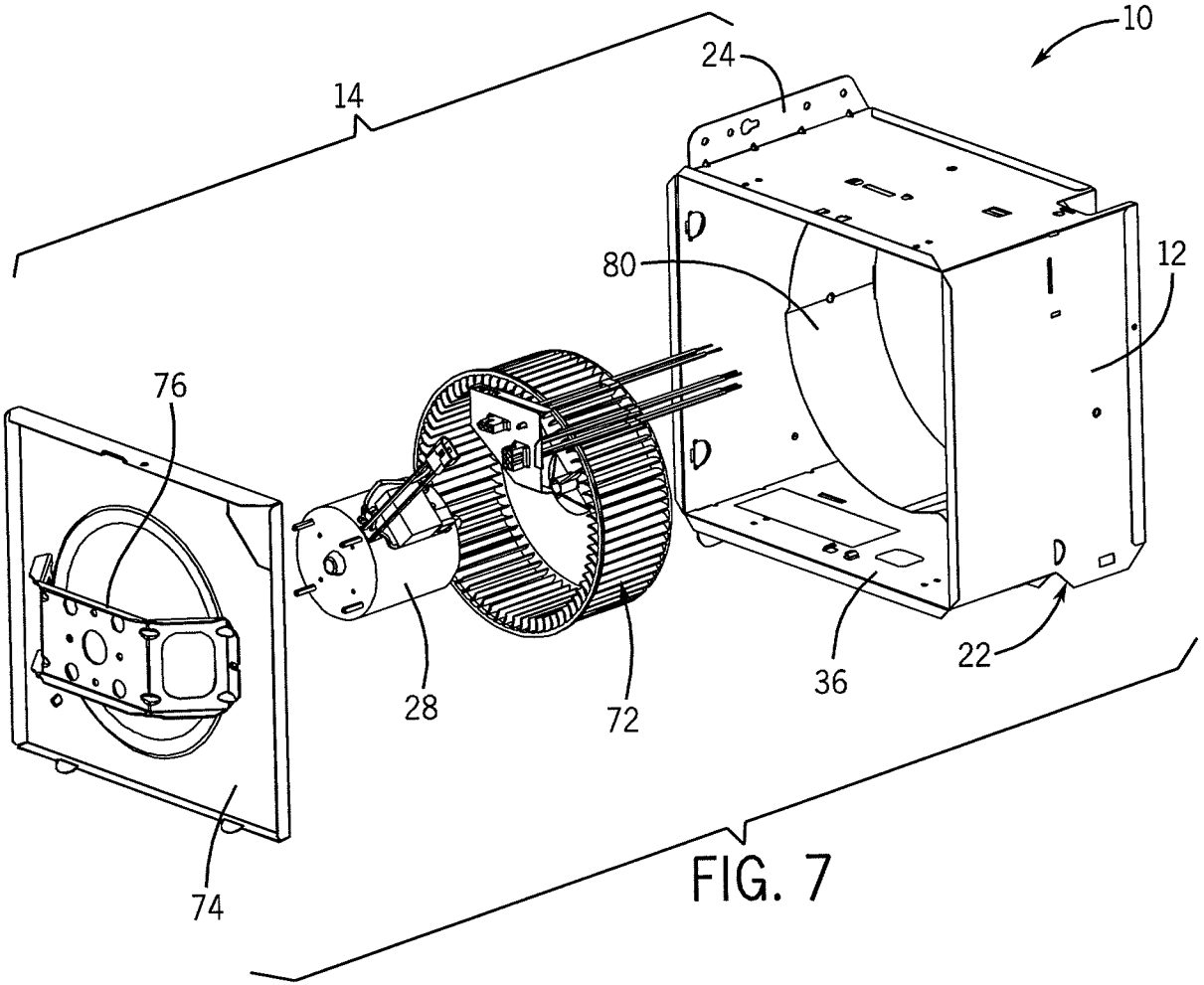
FIG. 7 is an exploded view of a lighting and ventilating system according to one embodiment of the invention.

As shown in FIGS. 1 and 7, in some embodiments, the main housing 12 can be formed of any material which can withstand varying temperatures (i.e., to withstand any heat radiated and/or conducted from the illumination devices, the motor, or other components) while providing structural support to the system 10. In some embodiments, the main housing 12 can be formed of sheet metal, however, the main housing 12 also can be fabricated from ceramic or a polymer having a relatively high melting temperature. The main housing 12 can be formed into any shape, including, but not limited to, a rectangular box-like shape, an oval shape, a hemispherical shape, a spherical shape, a pyramidal shape, or any other shape. The main housing 12 can form a base or a similar support structure of the system 10. Further, in some embodiments, the main housing 12 can provide points and areas of attachment for other components of the system 10.

As shown in FIGS. 1 and 7, in some embodiments, the main housing 12 can include or can be used in conjunction with at least one mounting apparatus 24 for installing the system 10 to any variety of support structures or surfaces. Any type of mounting apparatus 24 can be included with the main housing 12. In some embodiments, the main housing 12 can include two mounting apparatuses 24 fabricated from sheet metal. Although the mounting apparatuses 24 can be positioned anywhere on the main housing 12 so that the main housing can be supported with respect to any surrounding structure into which it can be installed, in some embodiments, the mounting apparatuses 24 can be positioned along opposite walls of the main housing 12. In other embodiments, the main housing 12 can be coupled to a support structure or a surface using a variety of fasteners and coupling methods (not shown).

In some embodiments of the invention, a grille 32 can be coupled to the main housing 12. In some embodiments, the grille 32 can be formed in a generally square-like shape, although the grille 32 can take any shape, including an oval shape, a hemispherical shape, a spherical shape, a pyramidal shape, or any other shape. Further, in some embodiments, the grille 32 can be configured so that it substantially matches the shape of the main housing 12. The grille 32 can be formed from injection-molded polymers, injection-molded polycarbonate, sheet metal, or any other suitable material.

As shown in FIG. 1, in some embodiments, the grille 32 can be positioned over an open end of the main housing 12. In some embodiments, the open end of the main housing 12 can be shaped and dimensioned to be received within an open end of the grille 32. The grille 32 can be secured to the main housing 12 by one or more snap-fit features on the grille 32 and/or the main housing 12. Additionally, in some embodiments, the one or more snap-fit features can be supplemented or largely replaced by any variety of couplings, such as screws, grille springs, bolts, rivets, pins, clamps, glue or other adhesive, and any other similar coupling. In some embodiments, the main housing 12 and the grille 32 can be further secured through other coupling practices such as welding, soldering, brazing, adhesive or cohesive bonding material, any combination of the foregoing, or any other similar coupling practice.

Referring to FIG. 7, in some embodiments, the main housing 12 can include one or more lips, flared edges, flanges, or other features to which the grille 32 can be coupled. In some embodiments, the main housing 12 can include a first set of peripheral flanges 34 to which the grille 32 can be coupled. In other embodiments, the grille 32 can be shaped and dimensioned to be received within the main housing 12 and the grille 32 can be coupled to the main housing 12 using any of the previously mentioned methods. In some embodiments, the grille 32 and the main housing 12 can include apertures through which fasteners can be passed to couple the grille 32 and the main housing 12. Any of the previously mentioned couplings can be used to couple the grille 32 and the main housing 12.

In some embodiments of the invention, the grille 32 can include the louvers 20. In some embodiments, the louvers 20 can extend across an inlet 36, which can be defined by the main housing 12. The louvers 20 can be used for receiving a flow of air. The louvers 20 can be located anywhere on the grille 32. In some embodiments, the location of the louvers 20 can be at least partially determined by airflow path(s) which can be available from the louvers 20, through the inlet 36, and into the ventilating assembly 14. In some embodiments, the louvers 20 can be angled between about zero degrees and about forty-five degrees from vertical when the system 10 is mounted in a horizontal ceiling, although the system 10 can be mounted in other locations. In some embodiments, the louvers 20 can be positioned substantially around a perimeter of a lighting aperture 38 of the grille 32. In some embodiments, the location of the louvers 20 can be selected substantially based on aesthetics, functionality, and other considerations which can be important to a user and/or a manufacturer.

As best seen in FIGS. 1-5, in some embodiments, the louvers 20 can guide air into the system 10. Air can include moisture, steam, exhaust, smoke, effluent, or anything similar. In some embodiments, after passing through the louvers 20 and entering the inlet 36 of the main housing 12, the air can enter the ventilating assembly 14, which can be included in the main housing 12, as discussed below. In some embodiments, the ventilating assembly 14 can be operable to discharge the airflow to another location, such as an attic, outside of the structure in which the system 10 can be secured, and/or to a duct network. Further, the airflow can be discharged from the ventilation outlet 22 of the main housing 12, in some embodiments.

According to some embodiments, the lighting aperture 38 can be located in a generally central area of the grille 32. In other embodiments, the lighting aperture 38 can be located generally anywhere on the grille 32. In yet other embodiments, the lighting aperture 38 can include multiple lighting apertures 38 located in either generally central areas of the grille 32 or anywhere on the grille 32. In some embodiments, the lighting aperture 38 can take a generally annular shape. In other embodiments, the lighting aperture 38 can take other shapes, including square, rectangular, polygonal, spherical, elliptical, or any other shape.

In some embodiments of the invention, the lighting aperture 38 can be positioned substantially centrally with respect to the grille 32, although in other embodiments, the lighting aperture 38 can be positioned elsewhere through the grille 32. In some embodiments, the lighting aperture 38 can be either generally recessed or generally elevated with respect to the grille 32. In other embodiments, the grille 32 and the lighting aperture 38 can be positioned so that the entire grille 32 can be generally planar. Further, in some embodiments, the lighting aperture 38 can be generally annular, however the lighting aperture 40 also can be generally square, rectangular, polygonal, spherical, elliptical, or any other shape. In some embodiments the shape of the lighting aperture 38 can be selected based on the shape of the lamp housing 16.

In some embodiments, the lamp housing 16 can be shaped and dimensioned to be received by the lighting aperture 38. In some embodiments, the lamp housing 16 can include a heat-resistant material, heat shielding, and/or reflective surfaces 50 to inhibit heat from contacting various components of the system 10. In some embodiments, the reflective surfaces 50 can generally direct light out of the system 10. In some embodiments, the lighting aperture 38 can generally support, hold, or sustain the lamp housing 16. In some embodiments, the lighting aperture 38 can include a mounting flange 40 which can be used to support the lamp housing 16. The mounting flange 40 can be located substantially entirely around the inner diameter of the lighting aperture 38 and can be integral with the lighting aperture 38. In other embodiments, the mounting flange 40 can comprise a plurality of mounting flanges located around the inner diameter of the lighting aperture 38.

Figure 3:
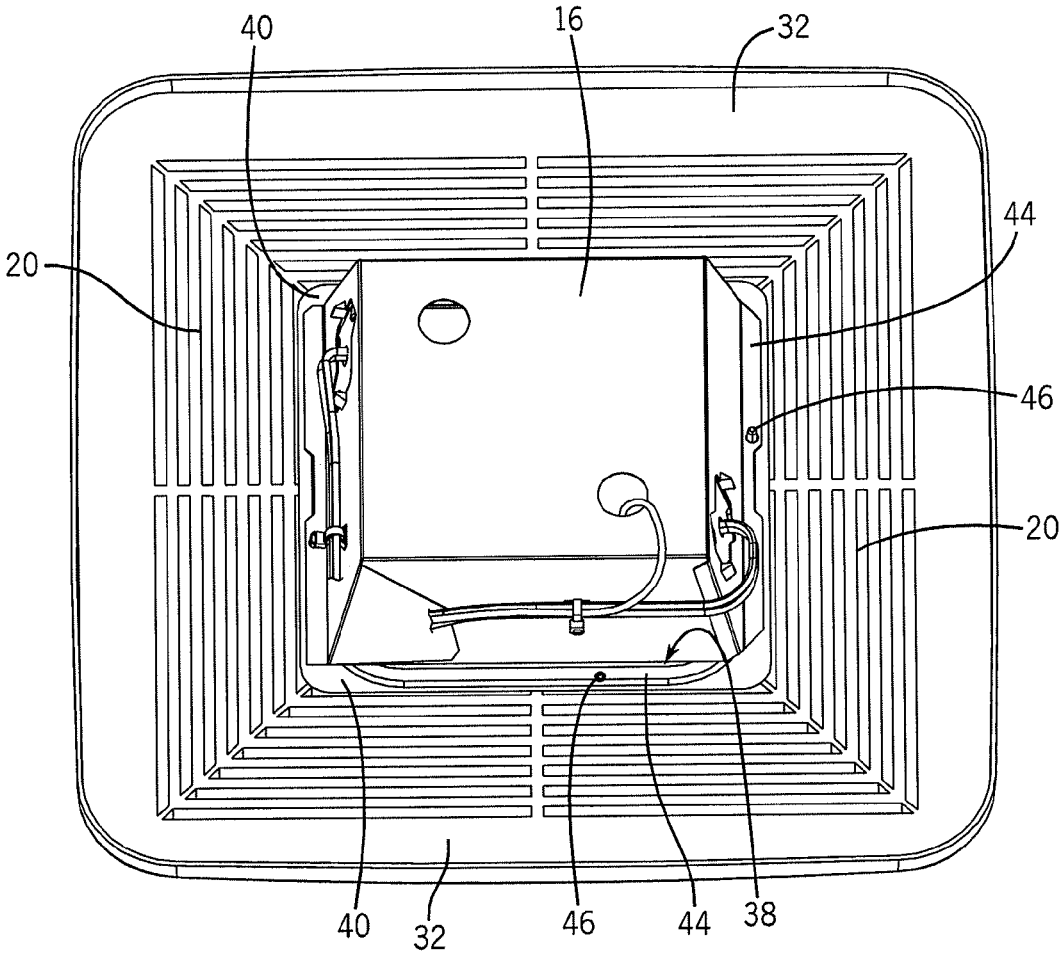
FIG. 3 is a bottom perspective view of a lamp housing and the grille according to one embodiment of the invention.
Figure 4:
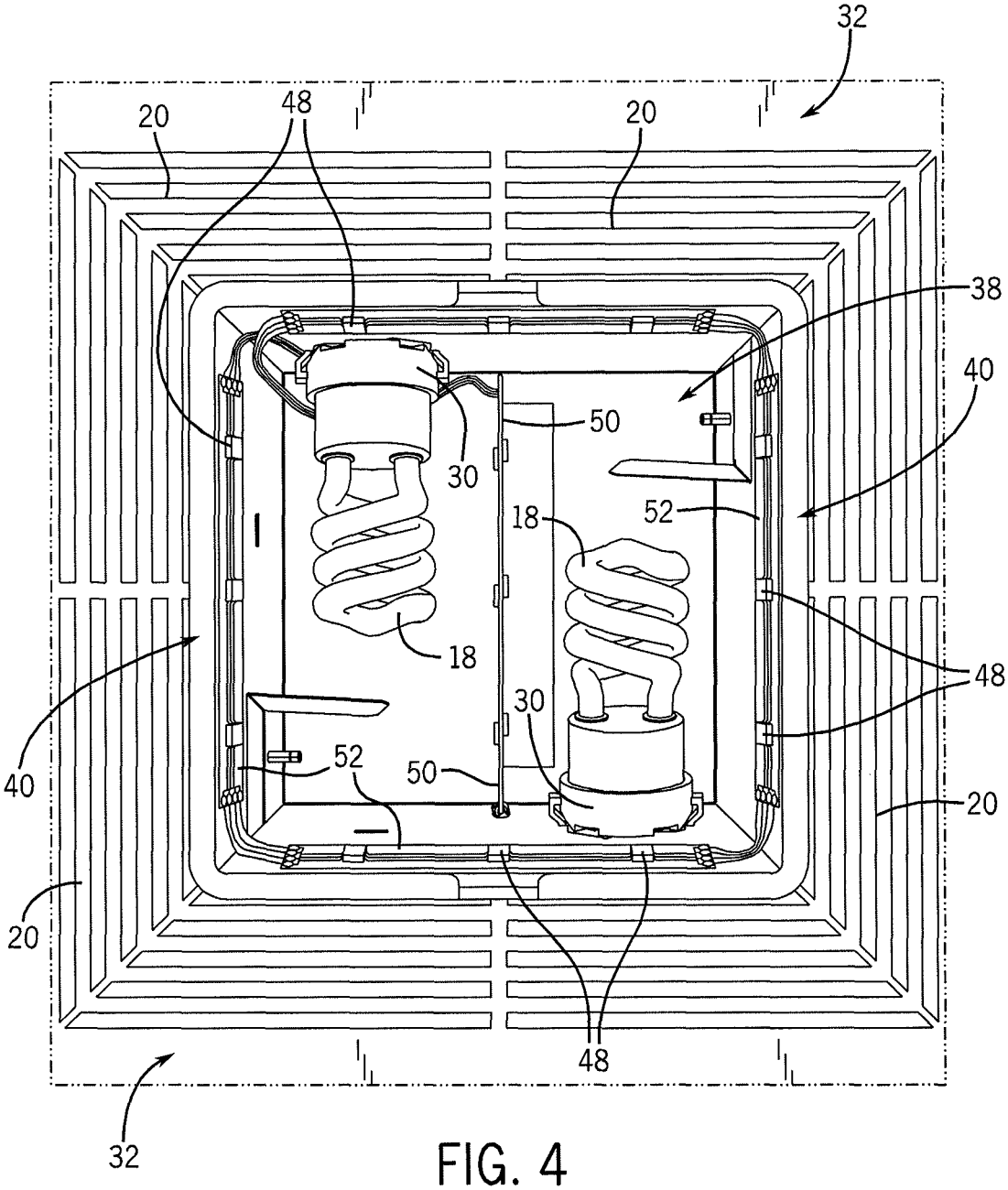
FIG. 4 is a top view of the lamp housing and the grille according to one embodiment of the invention.

As shown in FIGS. 3-4, in some embodiments, the lamp housing 16 can be secured to the mounting flange 40 by one or more snap-fit features on the lamp housing 16 and/or the mounting flange 40. Additionally, in some embodiments, the one or more snap-fit features can be supplemented or largely replaced by any variety of coupling, such as screws, bolts, rivets, pins, clamps, glue or other adhesive, and any other similar fastener. In some embodiments, the lamp housing 16 and the mounting flange 40 can be further secured through other coupling practices such as welding, soldering, brazing, adhesive or cohesive bonding material, any combination of the foregoing, or any other similar coupling practice.

In some embodiments, the lamp housing 16 can include one or more lips, flared edges, flanges, or other features to which the mounting flange 40 can be coupled. In some embodiments, the lamp housing 16 can include a second set of peripheral flanges 44 to which the mounting flange 40 can be attached. In some embodiments, the mounting flange 40 can include a set of pins 46 which can be received by a set of apertures included on the second set of peripheral flanges 44. In some embodiments, the connection between the pins 46 and the apertures of the flanges 44 can be further secured using any of the previously mentioned coupling methods. Further, in some embodiments, the mounting flange 40 and the lamp housing 16 can include apertures through which any of the previously mentioned fasteners/couplers can be passed to secure the mounting flange 40 to the lamp housing 16. In some embodiments, the lamp housing 16 can be directly coupled to the lighting aperture 38 and/or the grille 32 in any suitable manner. Further, in some embodiments, the lamp housing 16 can be directly coupled to the main housing 12 in any suitable manner.

In some embodiments, the lamp housing 16 can include the electrical sockets 30 and the first set of illumination devices 18, although some embodiments can include only one electrical socket 30 and one illumination device 18. In some embodiments, the electrical sockets 30 can be connected to the electrical components. The illumination devices 18 can contact the electric sockets 30, and, in some embodiments, when activated by the user, the illumination devices 18 can provide illumination to the room, area, or space. In some embodiments, the first set of illumination devices 18 can include incandescent, fluorescent, compact fluorescent, halogen, and other lights and lamps. Further, these lights can comprise flood lights, globe lights, light-emitting diodes (LEDs), or other similar lighting apparatuses, including a combination of any of the above.

Referring to FIG. 4, in some embodiments, the first set of illumination devices 18 can be configured to operate separately from one another. In some embodiments, a first set of illumination devices 18 can be configured to emit either a brighter or duller light than the remainder of the first set of illumination devices 18. Also, in some embodiments, the illumination devices 18 can be configured in any conventional manner to have one or more dimmed settings or can be controllable in a range of brightness.

In some embodiments, the lamp housing 16 also can include a second set of illumination devices 48. In some embodiments, the second set of illumination devices 48 can comprise LEDs, although the second set of illumination devices 48 also can include incandescent, fluorescent, compact fluorescent, halogen, and other lights and lamps. Further, the second set of illumination devices 48 can comprise flood lights, globe lights, or other similar lighting apparatuses, including a combination of any of the above.

In some embodiments, the second set of illumination devices 48 can be internally positioned with respect to the lamp housing 16. The second set of illumination devices 48 can be positioned along walls of the lamp housing 16, largely within a perimeter of the lamp housing 16. Further, in some embodiments, some of the second set of illumination devices 48 can be positioned on the reflective surfaces 50, although the second set of illumination devices 48 can be positioned anywhere in the system 10.

In some embodiments, at least one of the second set of illumination devices 48 can be coupled to control boards 52, although in some embodiments more than one of the second set of illumination devices 48 can be coupled to a control board 52. In some embodiments, the control boards with the second set of illumination devices 48 coupled to them, can be positioned along the walls of the lamp housing 16 and the reflective surfaces 50. Further, in some embodiments, the control boards 52 can be connected to electrical wiring so that the second set of illumination devices 48 can receive electricity and any operational directions potentially necessary for illumination.

In some embodiments of the invention, the second set of illumination devices 48 can be configured to operate independently of the first set of illumination devices 18. In some embodiments, the second set of illumination devices 48 can be configured to substantially automatically emit illumination when the area around the system 10 substantially lacks illumination (i.e., operate as a "night light"). In some embodiments, the second set of illumination devices 48 can be configured to emit illumination at the command of the user. The command of the user can include the user manually activating the second set of illumination devices 48, the user pre-programming automatic activation of the second set of illumination devices 48, the user pre-selecting times of the day for activation of the second set of illumination devices 48, or any other user-based commands. In some embodiments, both the first set 18 and the second set of illumination devices 48 can be configured to illuminate the same space at the same time.

Figure 5:
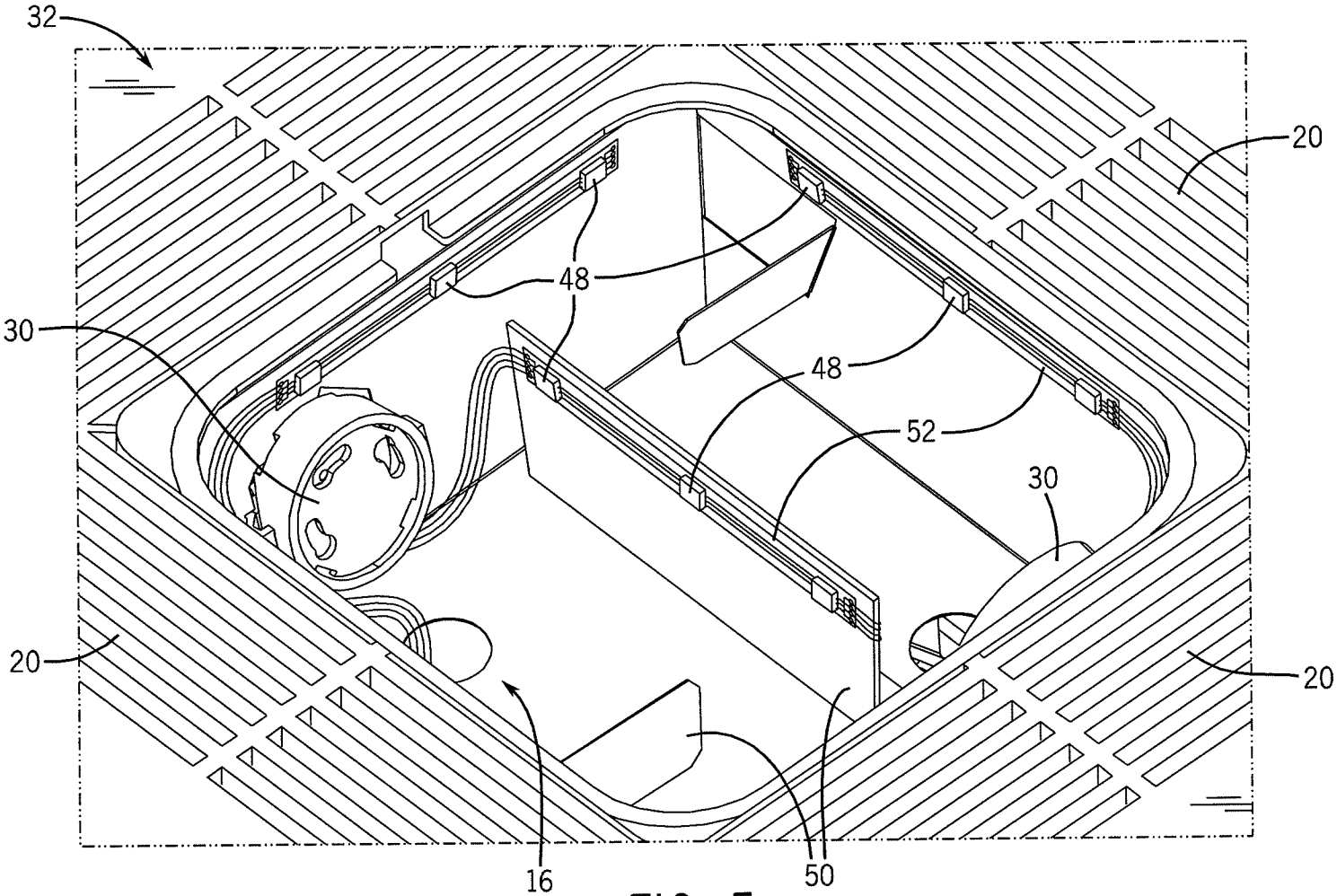
FIG. 5 is a top perspective view of the lamp housing and the grille according to one embodiment of the invention.

Referring to FIGS. 4 and 5, in some embodiments, the second set of illumination devices 48 can be configured to operate in cooperation with the first set of illumination devices 18. In some embodiments, the first set 18 and the second set of illumination devices 48 can be configured to be, at least partially, controlled by a motion-sensing monitor. In some embodiments, the motion-sensing monitor can activate the first set of illumination devices 18 when it detects any general movement and/or the monitor also can activate the second set of illumination devices 48. Additionally, in some embodiments, the second set of illumination devices 48 can emit a level of illumination which is generally lesser in intensity than its full capacity when system 10 is generally inactive, which can be signaled to the system 10 by the motion-sensing monitor. In some embodiments, the motion-sensing monitor can deactivate the first set of illumination devices 18 when it activates the second set of illumination devices 48, and vice versa. Further, in some embodiments, the second set of illumination devices 48 can be activated, including emission of various levels of illumination intensity, and the first set of illumination devices 18 can be deactivated when the space is generally unoccupied by a user and generally lacks other illumination. Conversely, the second set of illumination devices 48 can be deactivated and the first set of illumination devices 18 can be activated when the space is generally occupied by the user. Also, in some embodiments, the motion-sensing monitor can activate the second set of illumination devices 48 upon detection of any movement and deactivate the second set of illumination devices 48 when a general lack of movement occurs for any selected duration.

In some embodiments, the system 10 can include a dynamic illumination event. In some embodiments, the dynamic illumination event can be activated by either the motion-sensing monitor or an actuator positioned in the structure into which the system is installed. Additionally, the dynamic illumination event can be triggered by the user pre-programming activation of the system 10 for the dynamic illumination event.

In some embodiments, the dynamic illumination event can be largely provided by the second set of illumination devices 48. In some embodiments, upon triggering of the dynamic illumination event, the second set of illumination devices 48 generally can receive gradually increasing amounts of current, at least in part through the control boards 52, so that the intensity of the illumination emitted by the second set of illumination devices 48 can generally increase at approximately the same rate as the increase in current. The increase in illumination intensity can occur over a broad range of intensities and increments so that the space into which the system 10 is installed can gradually go from a general lack of illumination through gradually increasing intensities of illumination until the second set of illumination devices 48 emit a maximum amount of illumination. In some embodiments, a microprocessor (not shown) can control the gradual increase in current to the second set of illumination devices 48. Further, in some embodiments of the invention, the gradual increase can be provided by different power modulation techniques, including pulse-width modulation.

Additionally, in some embodiments, the rate of gradual increase in the amount of current to the second set of illumination devices 48 can comprise a generally constant ramp slope. More specifically, after activation, the gradual increase in current provided to the second set of illumination devices 18 can comprise a generally constant increase until the amount of current can reach the pre-programmed maximum and then the amount of current can comprise a generally constant current.

In some embodiments, the general increase in the amount of current can comprise a generally gradual onset ramp slope. More specifically, in some embodiments, after activation, the general increase in current can increase at a generally lesser rate at a point more temporally proximal to activation than a point more temporally distal from activation. For example, relatively soon after activation, the rate of increase can comprise a generally lesser rate of current increase relative to a point closer to the pre-programmed maximum. After reaching the pre-programmed maximum, the amount of current can comprise a generally constant current.

In some embodiments, deactivation of the dynamic illumination event can comprise a generally immediate loss of current to the second set of illumination devices 48. More specifically, deactivation can comprise a relatively immediate withdrawal of current provided to the second set of illumination devices 48. In some embodiments, deactivation can comprise a gradual decrease in current to the second set of illumination devices 48 so that the intensity of the second set of illumination devices generally correspondingly decreases until substantially less illumination radiates from the second set of illumination devices 48.

In some embodiments of the invention, the illumination emitted by the second set of illumination devices 48 during the dynamic illumination event can comprise a range of colored illumination. The color can be any color, include blue, green, purple, amber, or any other color. Further, in some embodiments, the range of colored illumination can include variations in hues of the same color. For example, if the colored illumination is blue, then color emitted by the second set of illumination devices 48 upon initial activation of the dynamic illumination event can be generally a darker hue of blue, and as the current increases, the color can become a generally lighter hue of blue.

Additionally, in some embodiments, the system 10 can include the capability to emit more than one color. In some embodiments, the user can select which color he or she prefers for the dynamic illumination event from any color which the system 10 can display. In some embodiments, the system 10 can include four colors from which the user can chose, although in other embodiments, the system can include any number of colors which the manufacturer or user desires.

In some embodiments, the user can use a selection actuator 54 to select the color of the dynamic illumination event. In some embodiments, the selection actuator 54 can be a dip switch, but in other embodiments, the selection actuator 54 can be a rotary switch, or any other suitable device. In some embodiments, the selection actuator 54 can be positioned substantially within the lamp housing 16, the main housing 12, the grille 32, or generally anywhere in or on the system 10, but in other embodiments, the selection actuator 54 can be installed in a remote location.

Figure 2:
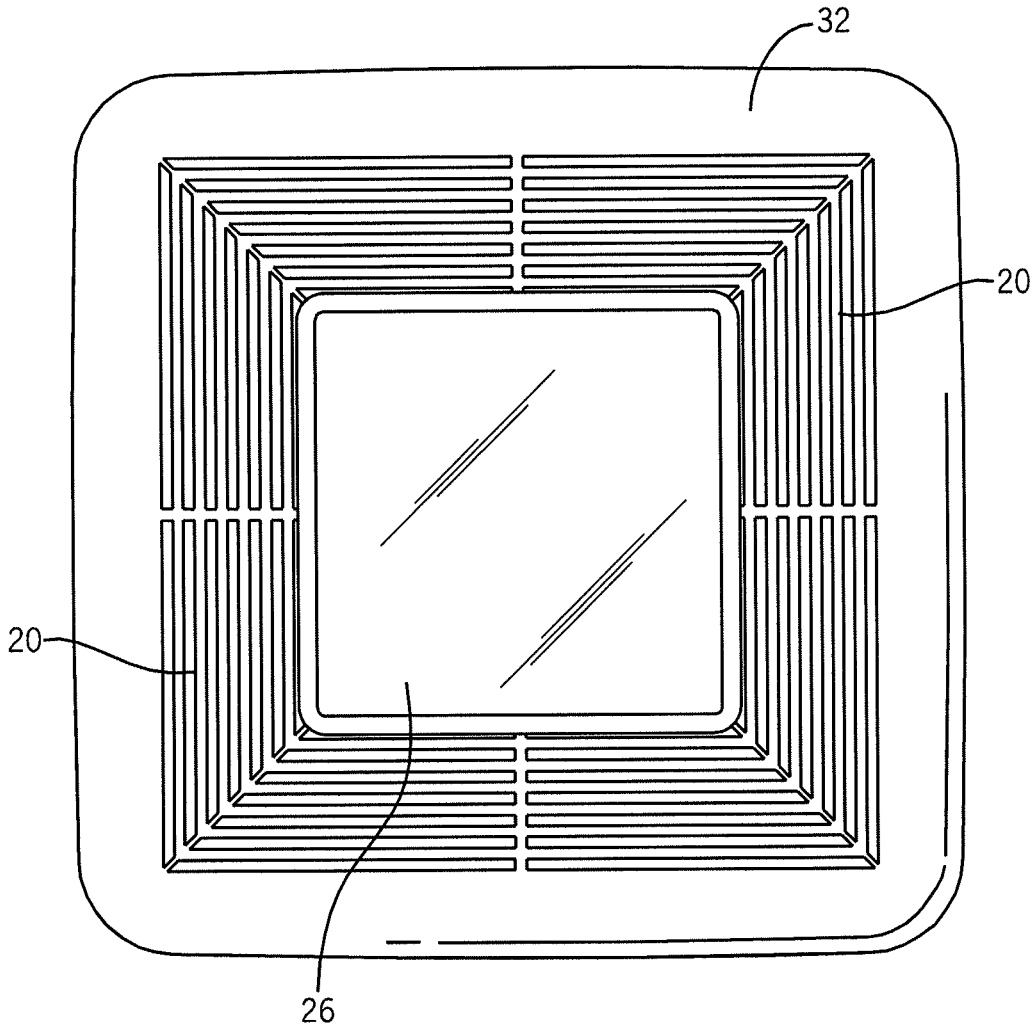
FIG. 2 is a perspective view of a grille according to one embodiment of the invention.

As illustrated in FIGS. 1 and 2, in some embodiments of the invention, the lens 26 can be coupled to the system 10. The lens 26 can aid in diffusing illumination emitted by either the first set 18 or the second set 48 of illumination devices. In some embodiments, the lens 26 can be coupled to the grille 32 by any of a number of the previously described coupling techniques, including snap-fitting, fasteners, or adhesives. Alternatively, the lens 26 can be integrally formed with either the grille 32.

Figure 6:
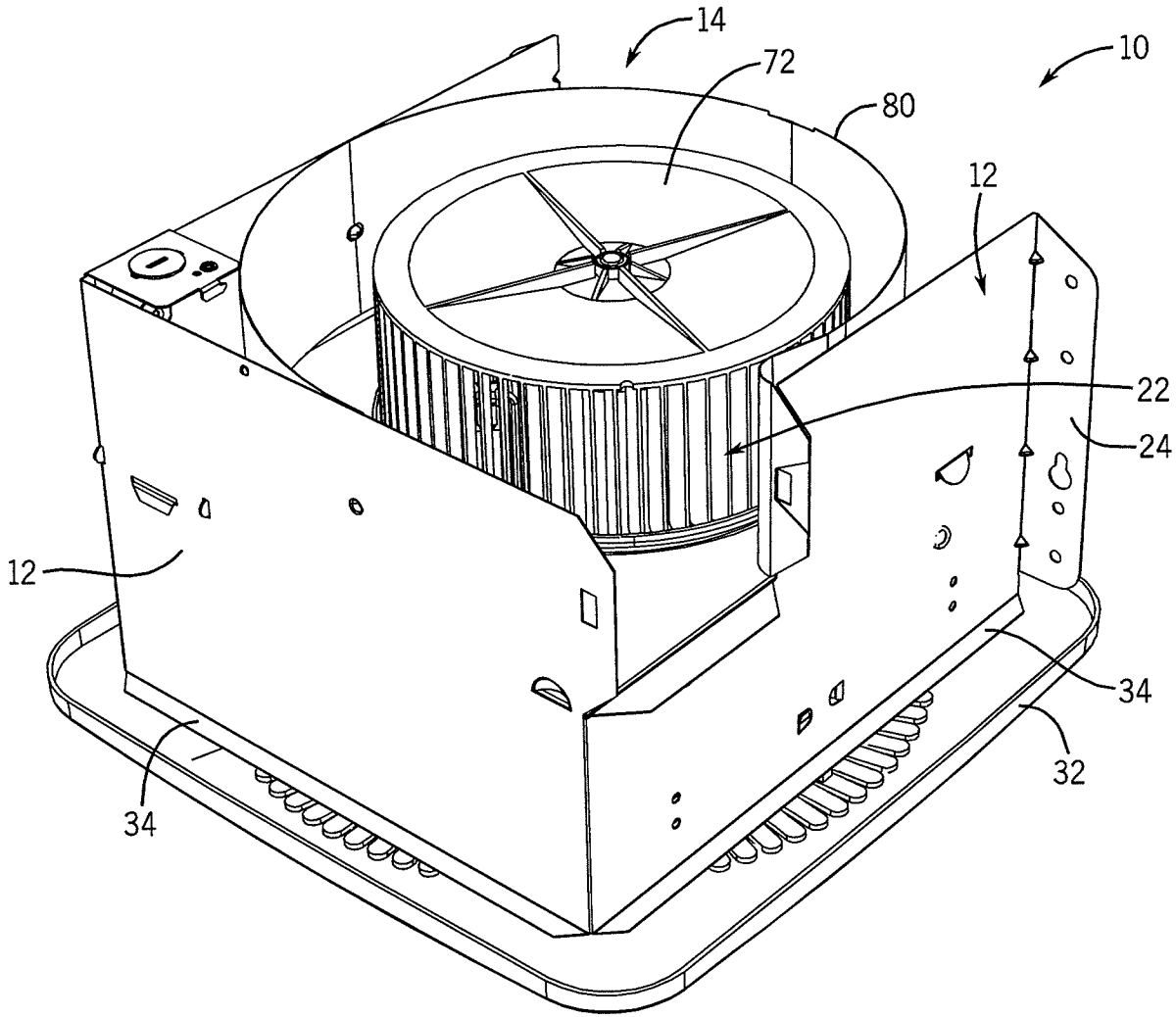
FIG. 6 is a perspective view of a lighting and ventilating system according to one embodiment of the invention.

Referring to FIGS. 6 and 7, in some embodiments of the invention, the ventilating assembly 14 can include a centrifugal fan or fan wheel 72 connected to a motor plate 74 or other structure within the main housing 12. In some embodiments, any other type of fan other than a centrifugal or fan wheel 72 can be employed, including propeller-type fans.

In some embodiments, the system 10 can include the motor 28 connected to the motor plate 74 by a bracket 76. The motor 28 can include a motor shaft, which can extend through the bracket 76 and/or the motor plate 74 to produce ventilating airflow. In some embodiments, the ventilating assembly 14 can be removeably connected within the main housing 14 as a single integral unit.

In some embodiments, when the ventilating assembly 14 is installed within the main housing 12, the fan 72 can be supported adjacent to an arcuate, upstanding wall 80. Together with a bottom wall of the main housing 12 and the motor plate 74, the upstanding wall 80 can define a scroll housing for generating airflow. In some embodiments, the fan wheel 72 can be positioned relative to the upstanding wall 80 to form a scroll inlet to receive air through the louvers 20, and a scroll outlet to discharge air out of the ventilating outlet 22.

In some embodiments, one or more power consuming devices, including, but not limited to the motor 28, the first and second set of illumination devices 18, 48, and the pilot light 70 can be powered by an internal electrical circuit of a building. In some embodiments, one common line from one side of the main housing 12 can provide an inlet for one or more lines of power to enter the main housing 12 and power one or more of the power-consuming devices.

In some embodiments, one or more switches, such as wall switches can be used to activate or deactivate any of the power-consuming devices. In some embodiments, three separate switches can be used to control the ventilating assembly 14, the first set of illumination devices 18, and the second set of illumination devices 48. In some embodiments, one switch can be used to control all three. Further, in some embodiments previously mentioned, the motion-sensing monitor can be used to control any of the ventilating assembly 14, the first set of illumination devices 18, and the second set of illumination devices 48.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A lighting and ventilating system for illuminating and ventilating a space comprising:

a main housing including an inlet through which air is received within the main housing and an outlet through which the air exits the main housing;

a grille coupled to the main housing, the grille including louvers; and a lamp housing coupled to the grille, the lamp housing including a first set of illumination devices and a second set of illumination devices, the second set of illumination devices capable of emitting a dynamic illumination event;

a fan wheel supported in the main housing, the fan wheel configured and arranged to extract air from the space through the grille to an area substantially away from the space capable of being illuminated by at least one of the first set of illumination devices and a second set of illumination devices; and wherein the air enters the main housing from the grille and exits the space through the outlet.

2. The lighting and ventilating system of claim 1, wherein the second set of illumination devices comprises light-emitting diodes.

3. The lighting and ventilating system of claim 1, wherein the illumination emitted by the second set of illumination devices comprises a generally blue hue.

4. The lighting and ventilating system of claim 1, wherein the illumination emitted by the second set of illumination devices comprises a generally green hue.

5. The lighting and ventilating system of claim 1, wherein the illumination emitted by the second set of illumination devices comprises a generally purple hue.

6. The lighting and ventilating system of claim 1, wherein the illumination emitted by the second set of illumination devices comprises a generally amber hue.

7. The lighting and ventilating system of claim 1, wherein the second set of illumination devices emit a lesser intensity of illumination relative to the second set of illumination device's full capacity when a space in which the system is installed substantially lacks illumination.

8. The lighting and ventilating system of claim 1, wherein the first and the second sets of illumination devices radiate different intensities of illumination.

9. The lighting and ventilating system of claim 1, and further comprising a microprocessor capable of substantially controlling the dynamic illumination event.

10. The lighting and ventilating system of claim 1, wherein the dynamic illumination event comprises a gradual increase in current to the second set of illumination devices, the general increase in current comprises one of a generally constant increase in current and a gradual onset increase in current.

11. A lighting and ventilating system for illuminating and ventilating a space comprising:

a main housing including an inlet through which air is received within the main housing and an outlet through which the air exits the main housing;

a grille coupled to the main housing, the grille includes a lighting aperture;

a lamp housing coupled to the grille substantially adjacent to the lighting aperture, the lamp housing including a first set of illumination devices and light-emitting diodes, the light-diodes capable of emitting a dynamic illumination event; and a fan wheel supported in the main housing, the fan wheel configured and arranged to extract air from the space through the grille to an area substantially away from the space capable of being illuminated by at least one of the first set of illumination devices and a second set of illumination devices; and wherein the air enters the main housing from the grille and exits the space through the outlet; and a microprocessor capable of substantially controlling the dynamic illumination event.

12. The lighting and ventilating system of claim 11, wherein the illumination emitted by the second set of illumination devices comprises a generally blue hue.

13. The lighting and ventilating system of claim 11, wherein the illumination emitted by the second set of illumination devices comprises a generally green hue.

14. The lighting and ventilating system of claim 11, wherein the illumination emitted by the second set of illumination devices comprises a generally purple hue.

15. The lighting and ventilating system of claim 11, wherein the illumination emitted by the second set of illumination devices comprises a generally amber hue.

16. The lighting and ventilating system of claim 11, wherein the dynamic illumination event comprises a gradual increase in current to the light-emitting diodes, the general increase in current comprises one of a generally constant increase in current and a gradual onset increase in current.

17. A method for lighting a space, the method comprising the acts of:

providing a main housing and a grille coupled to the main housing;

providing a lamp housing coupled to the grille, the lamp housing including a first set of illumination devices and a second set of illumination devices, the second set of illumination devices capable of emitting a dynamic illumination event; and activating the second set of illumination devices so that the second set of illumination devices produces the dynamic illumination event;

operating a fan wheel supported in the main housing to draw air into the main housing generally from the space to be illuminated through an inlet defined in the main housing and through louvers, through the grille, and out of the main housing and substantially away from the space through a ventilation outlet defined in the main housing.

* * * * *